US008733888B2

(12) United States Patent
Gaston et al.

(10) Patent No.: US 8,733,888 B2
(45) Date of Patent: May 27, 2014

(54) PRINTHEAD CLEANER

(75) Inventors: Gonzalo Gaston, Barcelona (ES); Esteve Comas, Sant Quirze Del Valles (ES); Diana Pilar Pascual, Barcelona (ES); Marta Coma, Barcelona (ES); Roger Bastardas, Sant Just Desvern (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 459 days.

(21) Appl. No.: 12/846,919

(22) Filed: Jul. 30, 2010

(65) Prior Publication Data

US 2012/0026241 A1 Feb. 2, 2012

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 4,116,399 | A | 9/1978 | Mosburger et al. | |
| 6,539,195 | B2 | 3/2003 | Sakaba et al. | |
| 2005/0007412 | A1 * | 1/2005 | Nishikawa et al. | 347/33 |
| 2006/0209152 | A1 * | 9/2006 | Baringa et al. | 347/104 |
| 2007/0188545 | A1 * | 8/2007 | Miyamoto | 347/33 |
| 2008/0226308 | A1 | 9/2008 | Burmeister et al. | |
| 2008/0252685 | A1 | 10/2008 | Gomez et al. | |
| 2008/0266342 | A1 * | 10/2008 | Steinfield et al. | 347/14 |
| 2008/0284813 | A1 * | 11/2008 | Koizumi et al. | 347/22 |
| 2009/0243204 | A1 | 10/2009 | Breunig et al. | |
| 2010/0053260 | A1 * | 3/2010 | Burmeister et al. | 347/33 |

FOREIGN PATENT DOCUMENTS

EP 0730960 A2 9/1996

* cited by examiner

*Primary Examiner* — Alejandro Valencia
(74) *Attorney, Agent, or Firm* — Garry A. Perry

(57) ABSTRACT

In one embodiment, a container or housing includes a body, a cavity and an aperture. A first and a second rotatable spindle are positioned within the cavity such that their long axes are substantially parallel, the first spindle to unwind unused wiping material, and the second spindle to wind used wiping material. A plurality of suspension devices connect to the body. A plurality of wipers are each connected to a discrete suspension device, each wiper including a wiping surface protruding through the aperture and each wiper to engage and wipe a discrete printhead during a wiping operation.

19 Claims, 9 Drawing Sheets

PRINTHEAD CLEANER

BACKGROUND

Printing systems, such as inkjet printers, may include one or more printheads. Each printhead includes a printing surface having a series of nozzles that are used to spray drops of ink. During operation of the printing systems, the printing surface may accumulate contaminants such as dried ink or drying ink. Such contaminants can partially or completely clog nozzles so as to severely affect the performance of the printing system and print quality.

One method of addressing the issue of accumulating contaminants is to periodically service the printhead to remove the contaminants/residue. Some printing systems include a service station that, among other things, periodically cleans the printing surface of the printhead by wiping the printing surface.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

FIG. 5*a* illustrates a printhead cleaner with a wiper and a suspension device in an idle position, and FIG. 5*b* illustrates the printhead cleaner of FIG. 5*a* when the wiper is engaged by a printhead.

DETAILED DESCRIPTION OF EMBODIMENTS

A service station may include a wiper and a supply of wiping material, the wiping material operable to be pressed by the wiper against printing surfaces of printheads to remove contaminants. During a wiping operation performed by a conventional service station; some printhead surfaces may receive more force than needed, resulting in the introduction of bubbles into the printhead's nozzles or damage to the nozzles. Other printhead surfaces may receive less wiping force than is needed, resulting in incomplete removal of the ink crusting formed on the surfaces. Further, a conventional service station may require that a user directly manipulate wiping material when replacing the used supply with an unused supply of wiping material. Embodiments of the present disclosure were developed to provide a printhead cleaner apparatus to be utilized within a service station. The disclosed apparatus includes a plurality of wipers, with each wiper connected to a discrete suspension device and to engage and wipe a discrete printhead surface with an independent wiping force during a wiping operation. The disclosed printhead cleaner apparatus is also configured to hold an unused roll of wiping material and a take-up roll in the same container or housing, such that a user is not required to manipulate a roll of wiping material and can simply install the apparatus and simply remove and replace the apparatus when it is full.

Figure 1:
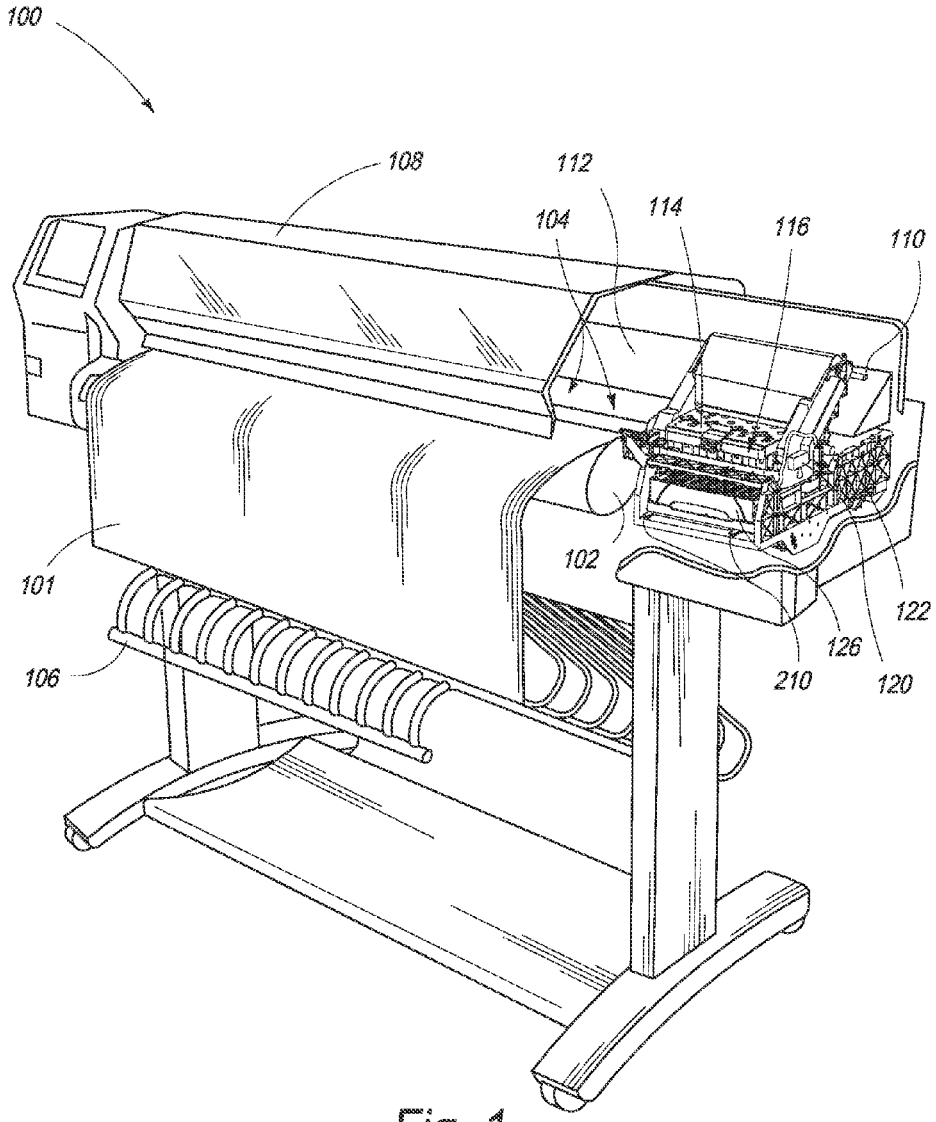
FIG. 1 is a perspective view illustrating an inkjet printer, according to one embodiment of the disclosure.

FIG. 1 illustrates an inkjet printer 100 implementing one embodiment of the disclosure. In an operating inkjet printer 100, paper or other print media 101 is fed from a supply roll 102 through a print zone 104, to an output tray 106. Inside a printer housing 108, a guide rod 110 mounted to a chassis 112 supports a reciprocating printhead carriage 114. Printhead carriage 114 carries a printhead assembly 116 back and forth on guide rod 110 through the print zone 104. During printing, a printer controller (not shown) selectively energizes ink ejector elements in a printhead, or group of printheads, within the printhead assembly 116 in an appropriate sequence to eject ink or other marking material on to the print media 101 in a pattern corresponding to the desired image. The printheads may be drop-on-demand inkjet printheads, thermo resistive printheads, piezo printheads or resistive printheads.

Printhead carriage 114 may carry a sensor 120, the sensor 120 capable of making various distance and/or light intensity measurements and passing them to the controller. Sensor 120 may be utilized in by the printer in determining a media attribute (e.g. location of edges or media skew), and/or in determining attributes of components within printer 100 (e.g. measuring a distance between a target and an edge of a viewing window, as discussed in paragraph [00030]). In embodiments in which the sensor 120 measures a distance, sensor 120 may be an optical sensor, an acoustic sensor or any type of distance measurement sensor. In embodiments in which the sensor 120 measures light intensity, sensor 120 may be a type of optical sensor.

A printer motor (not shown) that is situated within housing 108 that operates under the direction of a printhead controller moves printhead carriage 114 and printhead assembly 116 along the guide rod 110 and into and out of the print zone 104. The printer motor serves a second function of moving printhead carriage 114 and printhead assembly 116 into and out of a service station 122. Service station 122 includes a service station carriage (hereinafter referred to as a "sled") 124 (FIG. 2) that carries a printhead cleaner 126 across the face of printhead assembly 116 to wipe a printhead or printheads during a wiping operation. As used in this specification and the appended claims, a "wiping operation" means a maintenance event to clean a printhead by rubbing or friction. The printhead cleaner 126 may also perform capping, purging and spitting operations to prevent or clear clogged ink ejection orifices, with the sled 124 (FIG. 2) configured to carry the printhead cleaner 126 to positions relative to the printhead assembly that make capping, purging and spitting possible.

Figure 2:
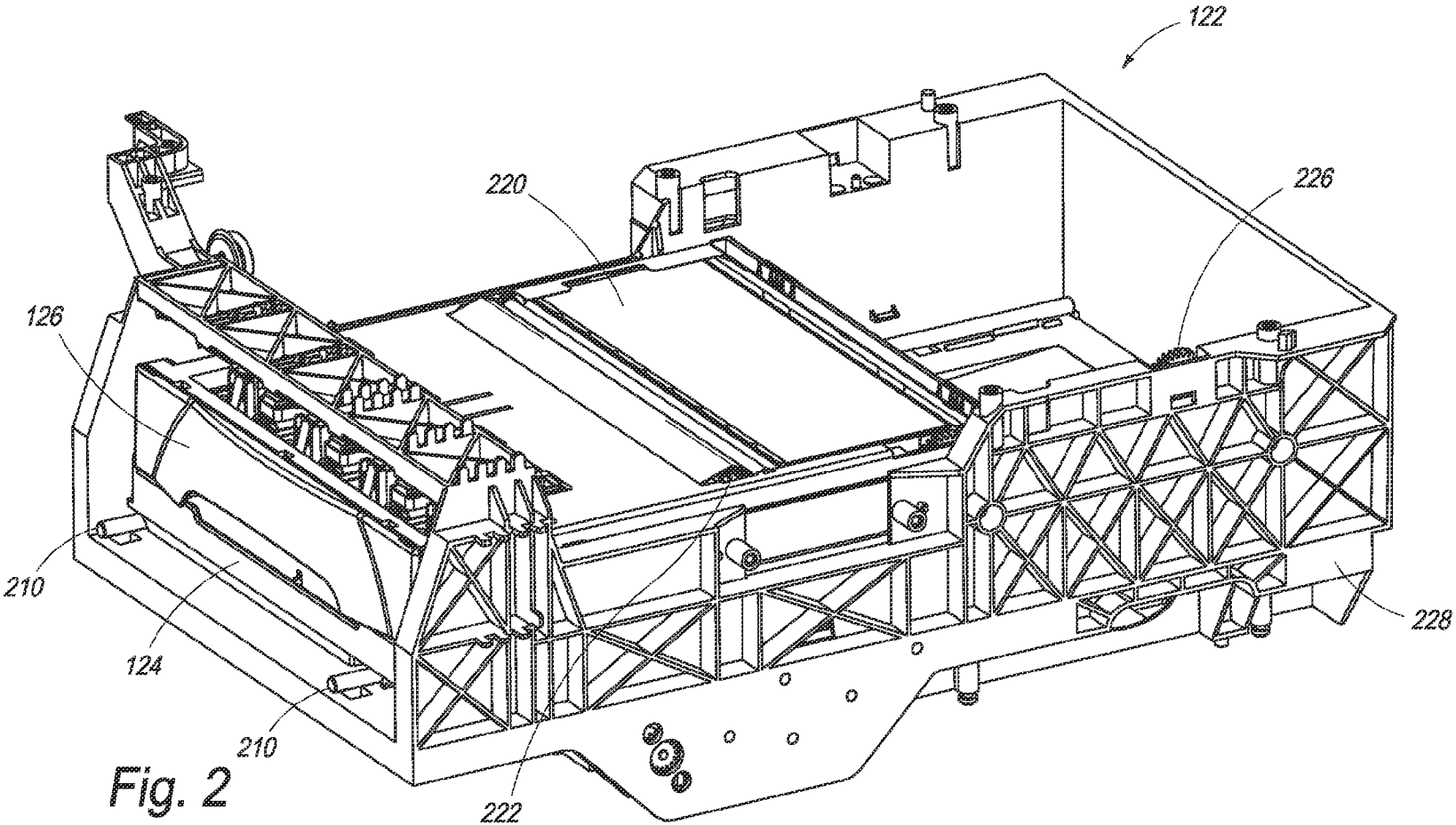
FIG. 2 is a perspective view illustrating a service station from the printer shown in FIG. 1, including a printhead cleaner, according to one embodiment of the disclosure.

FIG. 2 is a perspective view illustrating a service station from the printer shown in FIG. 1, including a printhead cleaner. The example service station 122 includes a sled 124 that is movable along rails 210 that attach to and run the length of the service station 122. In an embodiment, the disclosed printhead cleaner 126 is removably attached to the sled 124. The printhead cleaner 126 can be moved by the sled 124 to various positions within the service station 122 in order that the printhead cleaner 126 may perform various operations to clean the printheads. The printhead cleaner 126 is configured to hold a supply of wiping material 220, and includes wipers 222 to apply the wiping material 220 to printheads during a wiping operation. Only one wiper is visible in FIG. 2. The wipers are shown in greater detail in FIGS. 3*a*, 4, 5*a*, and 5*b*. In an embodiment, the service station 122 includes a driving mechanism 226 that is movably connected to the service station base 228. In an embodiment the driving mechanism comprises a gear or a plurality of gears. In an embodiment, the driving mechanism comprises a rack and a plurality of gears. The driving mechanism 226 is powered by a motor (not shown) and is operated under the direction of the controller. In an embodiment, the printhead cleaner 126 also includes priming receptacles 360 and printhead caps 362 (FIG. 4) to be utilized during a priming operation.

Figure 3A:
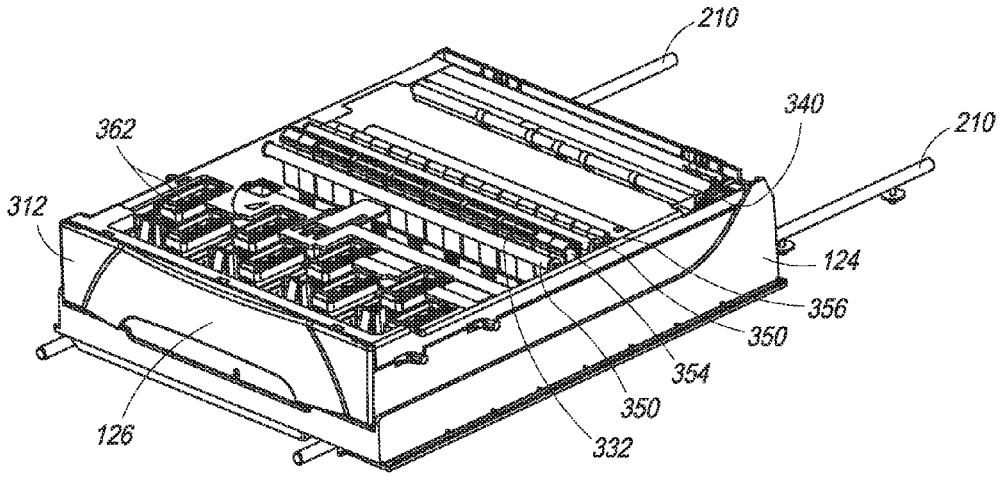
FIGS. 3*a* and 3*b* are perspective views illustrating an embodiment of a printhead cleaner. The printhead cleaner is shown without a wiping material in FIG. 3*a*, and including a wiping material in FIG. 3*b*.
Figure 3B:
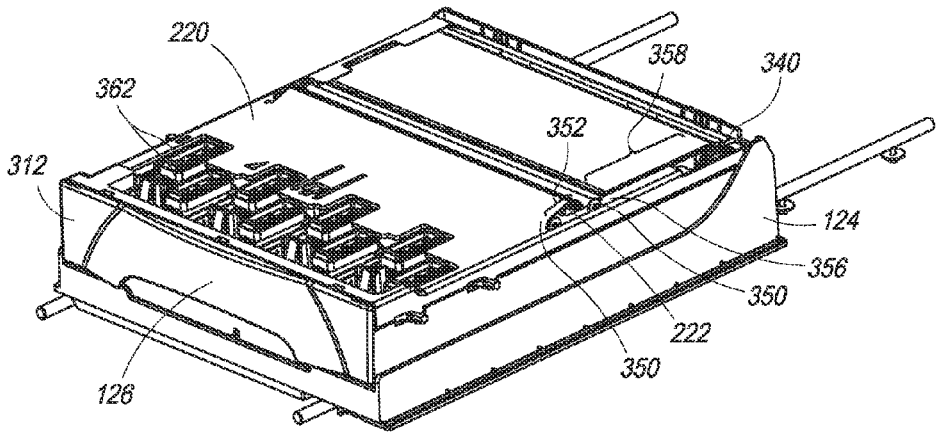
Figure 4:
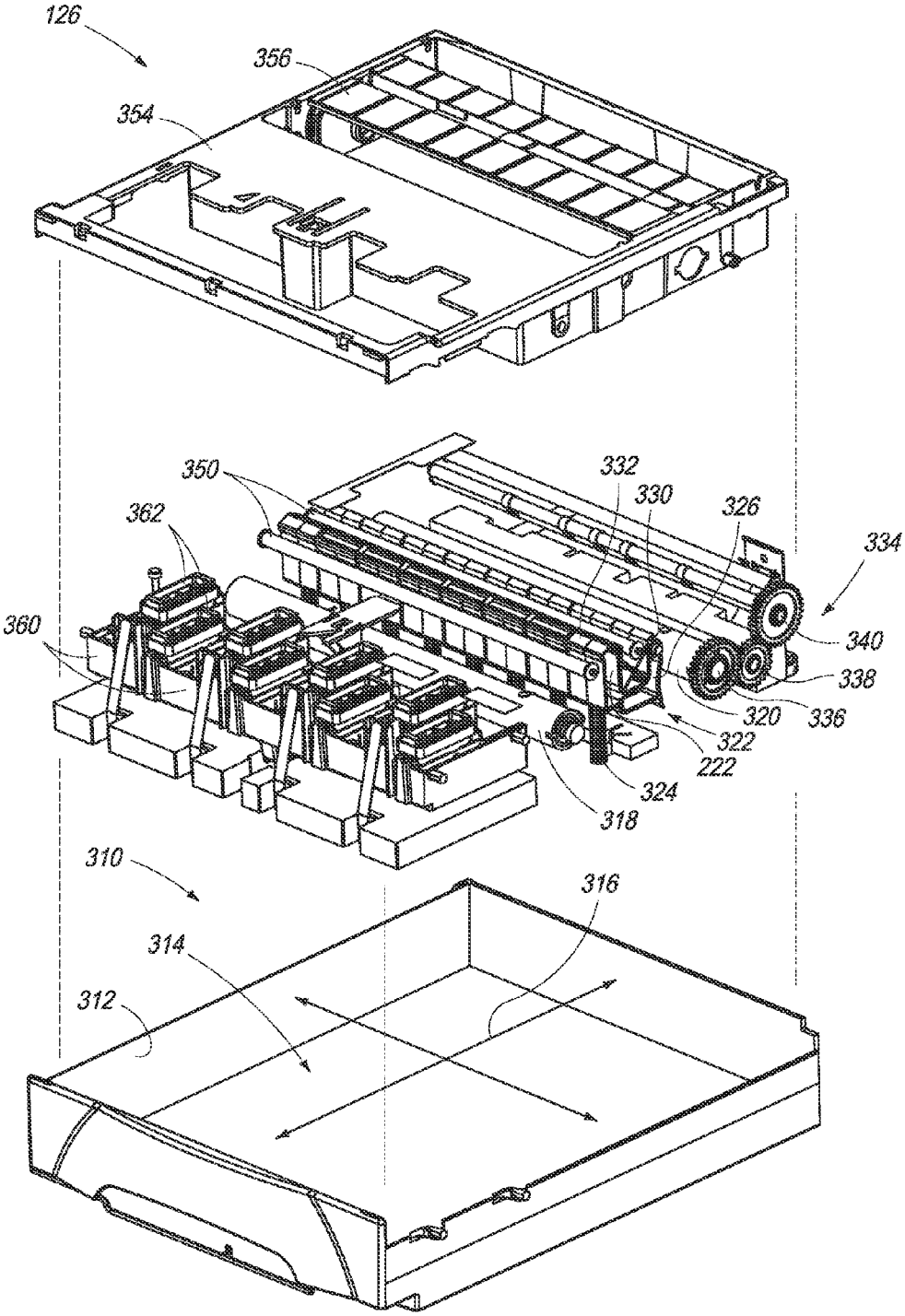
FIG. 4 is a detail exploded, generally perspective, view of the device shown in shown in FIG. 3*a*.

FIGS. 3*a* and 3*b* are perspective views illustrating an embodiment of a printhead cleaner. The printhead cleaner is shown in FIG. 3*a* without a wiping material installed in FIG. 3*a*, and is shown in FIG. 3*b* with a wiping material installed. FIG. 4 is a detail exploded, generally perspective, view of the device shown in shown in FIG. 3*a*. Beginning with FIGS. 3*a* and 4, in an embodiment the printhead cleaner 126 includes a container or housing 310, the container or housing 310 including a body 312, a cavity 314 that is formed or defined, or partially formed or defined, by the body 312, and an aperture 316 contiguous with cavity 314. A first rotatable spindle 318 and a second rotatable spindle 320 are positioned within the cavity 314 such that their long axes are substantially parallel, the first spindle 318 to unwind unused wiping material, and the second spindle 320 to wind used wiping material.

A plurality of suspension devices 322 connect to the body 312. In an embodiment, each suspension device 322 includes a biasing device 324 that is connected to the body 312, a supporting member 326 that is connected to the biasing device 324 and operable to rotate around an axis. In an embodiment, a first elongated 330 member is positioned within the cavity 314 to serve as an axis for a plurality of the supporting members 322, the first elongated member 330 with a length that is substantially parallel to the lengths of the first spindle and second spindles. In an embodiment, the first elongated member 330 serves as an axis for each of the supporting members 322.

The printhead cleaner 126 includes a plurality of wipers 222, each wiper 222 connected to a discrete suspension device 322. Each wiper 222 includes a wiping surface 332 protruding through the aperture 316 to engage and wipe a discrete printhead during a wiping operation. In an embodiment the wiper comprises a rubber, plastic or polymeric material. The wiping force is independent for each discrete printhead during the wiping operation. In an embodiment, each wiper 222 includes a plurality of wiping surfaces 332. In the illustrated embodiment, each wiper 222 has three wiping surfaces. In other embodiments, the wipers 222 may comprise one, two, four, or more than four wiping surfaces 332.

In an embodiment, a transmission 334 is connected to the body 312 and is operably connected to the second spindle 320 to drive the second spindle 320. In the illustrated embodiment, the transmission 334 includes a first gear 336 movably connected to the second spindle 320, a second gear 338 movably connected to the first gear 336, and a third gear 340 is movably connected to the second gear 338. The third gear 340 is configured to engage the driving mechanism 226 of the service station 122 (FIG. 2). When the sled 124 is in a first position at which the third gear 340 and the driving mechanism 226 are engaged, advancing the driving mechanism 226 with a motor will cause the transmission 334 to rotate the second spindle 320. Rotation of the second spindle 320 will take up used wiping material, and the taking up will cause the first spindle 318 to rotate and distribute unused wiping material. In an embodiment, the third gear 340 and the driving mechanism 226 are disengaged when the sled 124 is in any position other than the first position.

Figure 9A:
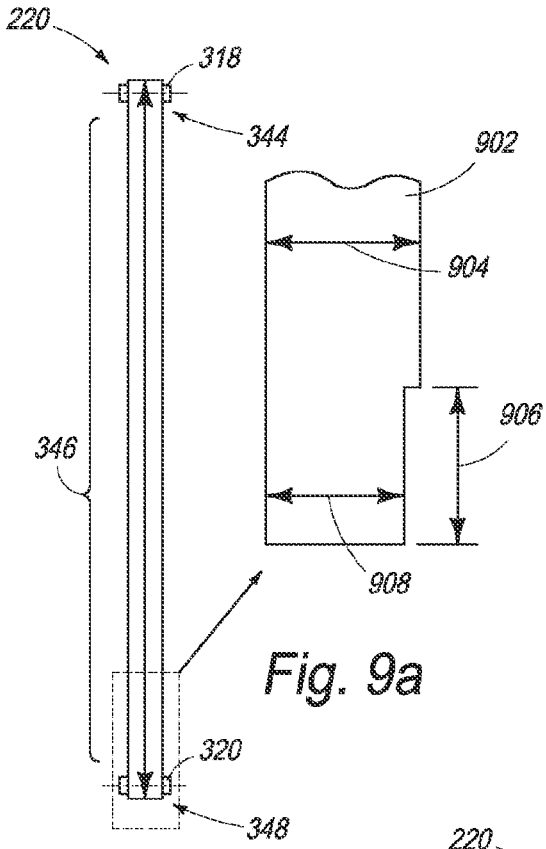
FIGS. 9*a* and 9*b* are top down views of lengths of wiping material according to an embodiment of this disclosure.

Moving to FIGS. 3*b* and 4, the printhead cleaner 126 may further comprise a wiping material 220 that includes a first end portion 344, a middle portion 346, and a second end portion 348 (FIG. 9*a*). In an embodiment, the wiping material 220 may include a continuous length of flexible material configured to be brought in to contact with and/or pressed against nozzles of printheads to service the printheads. The wiping material may include an absorbent material (not shown) that is configured to hold a servicing liquid. In an embodiment, the absorbent material may include non-woven polymeric or non-polymeric materials that may be configured to absorb liquid. For example, the wiping material may include a nonwoven polymeric material, such as EVOLON. In an embodiment, the absorbent material may include a woven material.

The wiping material 220 may be impregnated with one or more servicing liquids (not shown) configured to clean a printhead when the wiping material 220 contacts and/or presses against a printhead. The wiping material 220 may be impregnated with the servicing liquid at any suitable concentrations. The servicing liquid may have any suitable properties configured to clean a printhead. The servicing liquid may include a solvent that does not evaporate at ambient printer conditions. As used in this specification, "ambient printer conditions" means environmental conditions inside an operating printer. The servicing liquid may have a boiling point substantially greater than the exterior temperature of an operating printhead, to prevent evaporation of the servicing liquid during operation of a printer. In an embodiment, the servicing liquid may comprise a solvent with a boiling point greater than about two hundred degrees C.

The wiping material 220 is positioned such that the first end portion 344 (FIG. 9*a*) is attached to the first spindle 318, and the second end portion 348 (FIG. 9*a*) is attached to the second spindle 320. The middle portion 346 (FIG. 9*a*) comprises all of the wiping material 220 other than the first and second end portions. In an embodiment, the first end portion comprises a first edge, and the second end portion comprises a second edge. Rollers or other rotatable members 350 that are movably attached or movably connected to the body 312 are operably connected to the middle portion 346 (FIG. 9*a*), the rollers or other rotatable members to suspend a part or a segment of the middle portion 346 (FIG. 9*a*) to form a wiping part or segment 352. The wiping part or segment 352 is adjacent and exterior to, or abuts, the wiping surfaces 332, and is the part or segment of the wiping material 220 that contacts printhead surfaces and the wiping surfaces 332 during a wiping operation.

In an embodiment, after a wiping operation the driving mechanism 226 (FIG. 2) engages the third gear 340 to advance the transmission 334 and the second spindle 320, thereby moving used wiping material that had served as the wiping segment 352 away from the wiping surfaces 332, and moving clean wiping material into a position abutting the wiping surfaces 332 and to serve as a new wiping segment 352.

In an embodiment, the printhead cleaner 126 additionally comprises a second elongated member 356 (FIG. 4) that is connected to the body 312 and is positioned across the aperture 316, the second elongated member 356 (FIG. 4) to support a length 358 (FIG. 3*b*) of the wiping material to serve as a spittoon during a printhead spitting operation. As used in this specification and the appended claims, a "spitting operation" means a maintenance event to clean a printhead by energizing ejector elements within the printhead to spray excess ink or other liquid through printhead nozzles. In an embodiment, the second elongated member 356 is a portion of a molded cover 354, the cover 354 connected to the body 312 and comprised within the printhead cleaner 126.

In an embodiment, the printhead cleaner 126 further comprises a plurality of priming receptacles 360 that are connected to the body 312 and includes printhead caps 362 positioned adjacent to the aperture 316. The printhead caps 362 are operable to engage a plurality of printheads and the priming receptacles 360 are operable to receive a liquid from the printheads during a priming operation. As used in this specification and the appended claims, a "priming operation" means a maintenance event to clean a printhead by forcibly extracting ink or other liquid from the printhead. In an embodiment, the priming receptacles 360 and printhead caps 362 are configured to receive ink that is expelled from printhead nozzles via a positive pressure gradient applied to the printheads, the gradient applied via an ink pump connected to the printhead. In an embodiment, the priming receptacles 360 and printhead caps 362 are configured to receive ink that is expelled from printhead nozzles via a negative pressure gradient, the gradient applied via a suction device connected to the printhead caps 362. In an embodiment, the printhead caps 362 may be utilized to engage a plurality of printheads without a priming operation occurring, e.g. between print jobs or during a power down operation.

Figure 5A:
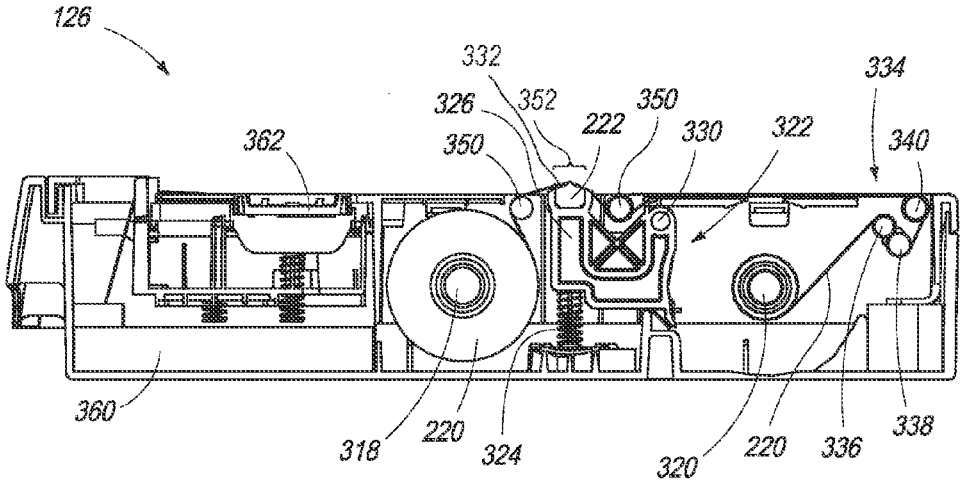
FIGS. 5*a* and 5*b* are detailed cross section views of the printhead cleaner that is shown in FIGS. 3*a*, 3*b*, and 4.
Figure 5B:
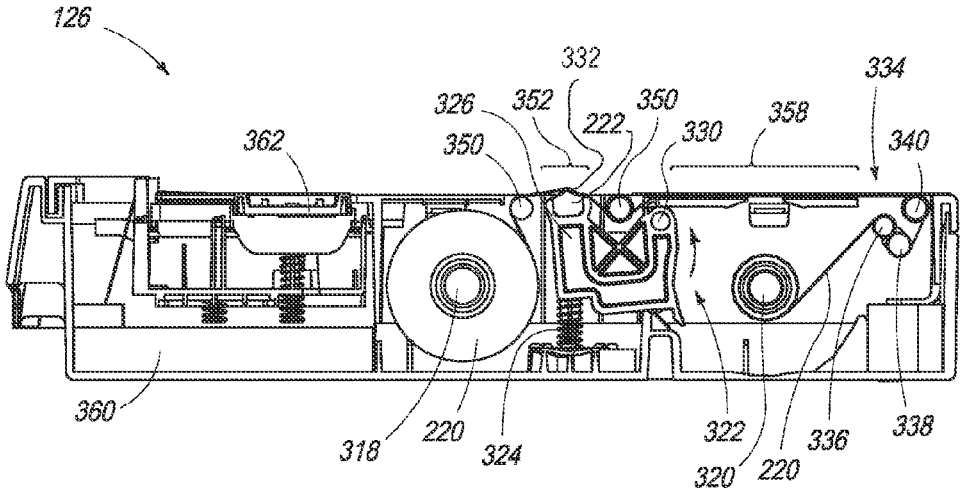

FIGS. 5*a* and 5*b* are detailed cross section views of the printhead cleaner that is shown in FIGS. 3*a* and 3*b*. FIG. 5*a* illustrates a printhead cleaner with a wiper and a suspension device in an idle position, and FIG. 5*b* illustrates the printhead cleaner of FIG. 5*a* when the wiper is engaged by a printhead. Beginning with FIG. 5*a*, when the printhead cleaner 126 is in an idle position, i.e. not cleaning a printhead, the wipers 222 are in a fully extended position with the wiping surfaces 332 protruding through the aperture 316 (FIG. 4) awaiting contact with a printhead. Moving to FIG. 5*b*, when the printhead cleaner 126 is brought into contact with a printhead by virtue of movement of the sled 124 (FIG. 3*a*), pressure from the contact causes the wiper to move away from the contact point and causes the wiper's associated supporting member 326 to rotate around the wiper's associated axis. In an embodiment each wiper 222 comprises three wiping surfaces 332. Rotation of a supporting member 326 around the first elongated member 330 causes all three of the wiping surfaces 332 to contact the printhead during passing of the sled 124 (FIG. 3*a*) and the printhead cleaner 126 beneath the printheads. As the printhead cleaner 126 comprises a plurality of wipers 222 each connected to a discrete suspension device 322, the wiping force during a wiping operation is independent for each discrete printhead. In other embodiments, a wiper 222 may comprise one, two, four, or more than four wiping surfaces 332.

Figure 6A:
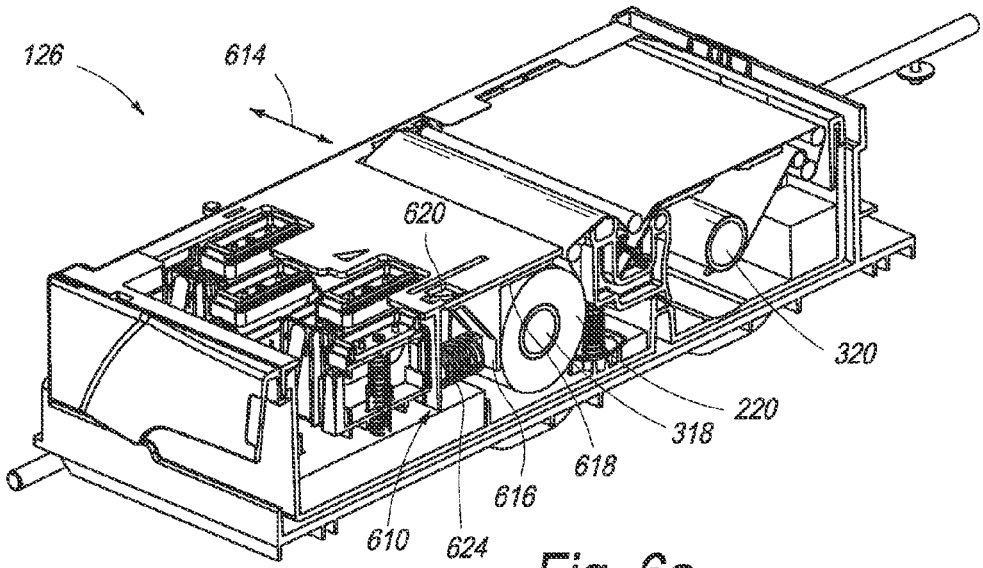
FIG. 6*a* is a perspective cross-section view illustrating an embodiment of a printhead cleaner that includes a following member and a window to indicate when a first spindle is nearly empty of unused wiping material.
Figure 6B:
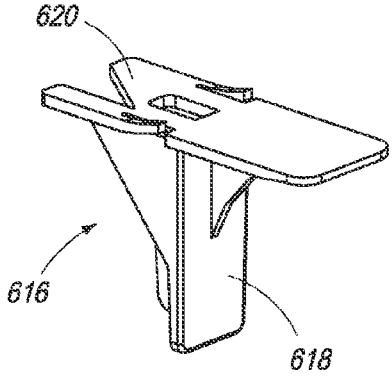
FIGS. 6*b* and 6*c* are isolation views of the following member of FIG. 6*a*
Figure 6C:
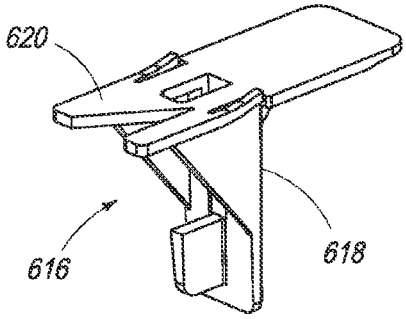
Figure 7:
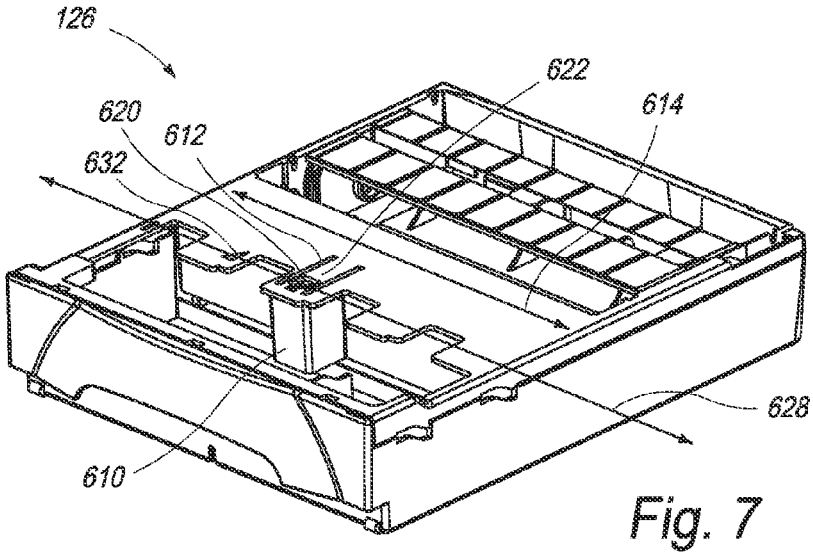
FIG. 7 is a partial perspective view of the printhead cleaner of FIG. 6*a*.

FIG. 6*a* is a perspective cross-section view illustrating an embodiment of a printhead cleaner that includes a following member and a first window to indicate when a first spindle is nearly empty of unused wiping material. FIGS. 6*b* and 6*c* are isolation views of the following member of FIG. 6*a*. FIG. 7 is a partial perspective view of the printhead cleaner of FIG. 6*a*, illustrating more detail of the following member and the first window. FIGS. 8*a*, 8*b*, 8*c* and 8*d* are top down views of the printhead cleaner of FIG. 6*a*, illustrating additional detail of the following member and first window. In an embodiment of the disclosure, a chamber 610 is comprised within the printhead cleaner 126 and partially encloses the first spindle 318. In an embodiment, the chamber 610 is comprised within a cover 354 that is connected to the body 312. In an embodiment, the chamber 610 is comprised within the body 312. In an embodiment, the chamber 610 is connected to the body 312 and partially encloses the first spindle 318. A path 612 is comprised within the chamber 610, the length of the path 612 perpendicular to and adjacent to the long axis 614 of the first spindle 318. In an embodiment, the path may comprise a slot, or a plurality of slots, to guide a following member. A following member 616 is movably connected to and movable along the path 612, the following member 616 including a contact portion 618 to engage wiping material 220 held by the first spindle 318, and a target portion 620 to be detected by a sensor 120 (FIG. 1). A first window 622 is comprised within the chamber 610, the first window 622 adjacent to the path 612 and to reveal the target portion 620 to the sensor 120 that is carried on the printhead carriage 114 (FIG. 1).

In an embodiment the target portion 620 has a triangular shape and is positioned such that the amount of the target portion 620 that is visible to the sensor 120 along a scan axis 628 through the first window 622 varies in proportion to the amount of wiping material 220 remaining on the first spindle 318. As used in this specification, a "scan axis" means a path taken by a sensor that is carried by a printhead carriage. A biasing device 624 is connected to the chamber 610 and to the following member 616, the biasing device 624 to bias the following member 616 towards the first spindle 318. In the illustrated embodiment the amount of wiping material 220 remaining on the first spindle 318 is discernable by using the sensor 120 to measure a distance, along a scan axis 628, from the hypotenuse of the triangular target portion 620 to one of the edges of the first window 622, and comparing the measured distance to a lookup table stored in printer memory. In another embodiment, the sensor 120 may be utilized to measure, along the scan axis 628, a measured distance of the width of the target portion 620 that is visible in the first window 622.

Figure 8A:
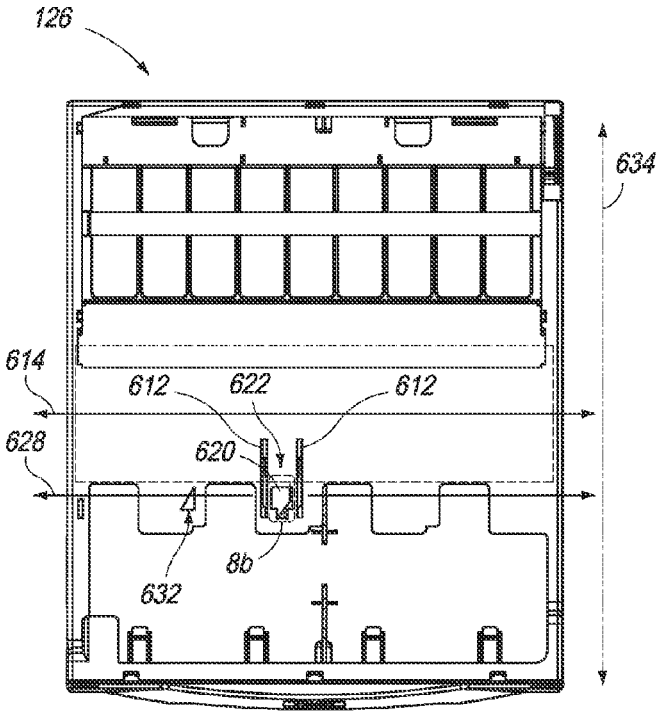
FIGS. 8*a*, 8*b*, 8*c*, and 8*d* are top down views of the printhead cleaner of FIG. 7, illustrating additional detail of the following member and window.
Figure 8B:
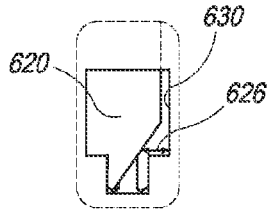

Moving to FIGS. 8*a* and 8*b*, in an example the measured distance 626 along a scan axis 628 from the target portion 620 to an edge 630 of the first window 622 is 3 mm, and a lookup table indicates that at 3 mm measurement is expected when one meter of wiping material 220 remains on the first spindle 318 (FIG. 6*a*), The printer may be configured to send a message to a user that the wiping material 220 is nearly consumed when one meter or less of wiping materials 220 remains on the first spindle 318 (FIG. 6*a*).

Figure 8D:
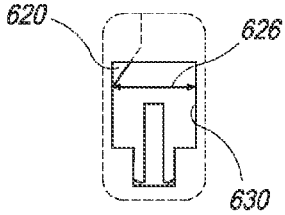
Figure 8C:
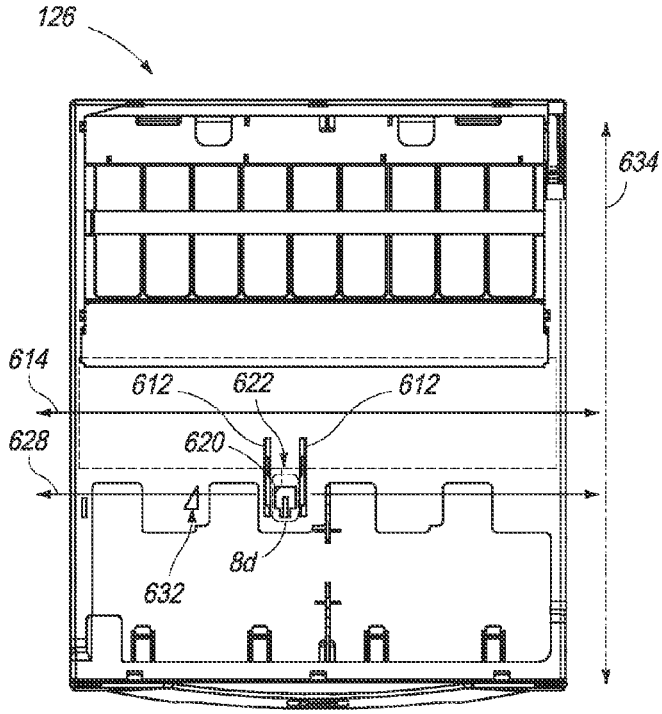

Moving to FIGS. 8*c* and 8*d*, in another example, a 6.0 mm measured distance 626 along the scan axis 628 from the target portion 620 to an edge 630 of the first window 622 indicates that the wiping material 220 is entirely consumed. In an embodiment, a printer may be configured to suspend all wiping and/or printing operations until the printhead cleaner 126 is removed and replaced with a new printhead cleaner that contains a new supply of wiping material.

In an embodiment, the printhead cleaner 126 includes a second window 632 that when scanned by the sensor 120 (FIG. 1) provides information to the controller regarding any offset of the actual position of the printhead cleaner 126 along the rails 210 (FIG. 2) compared to a planned position for the printhead cleaner 126. In the illustrated embodiment the second window 632 is in the shape of a triangle, and an offset in the actual and planned positions of the printhead cleaner 126 is discernable by using a sensor 120 (FIG. 1) to measure a distance 626 along the scan axis 628 from the hypotenuse of the triangle to one of the sides of the first window 622, and comparing the measured distance to an expected distance when the printhead cleaner 126 is correctly positioned. In an example, if the expected measurement is 2 mm and the measured distance is 1 mm, the 1 mm measurement from the hypotenuse of the triangle to one of the sides of the first window 622 indicates that the printhead cleaner 126 and/or the printhead carriage 114 is out of position. Utilizing a lookup table stored in printer memory, a printer's controller may determine a compensation formula commensurate with the measured distance. The controller may apply the compensation formula to other measurements of distance made by the sensor while the printhead cleaner is the same incorrect position (e.g. the measurements of a distance between the target portion 620 of the following member 616 and an edge of the first window 622 described in paragraphs [00030]-[00032]).

In the embodiments illustrated in FIGS. 6*a*, 7, 8*a* and 8*c*, the sensor distance measurements involving the target portion 620 of the following member 616, the first window 622, and/or the second window 632 are made while the printhead cleaner 126 is stationary and the printhead carriage 114 moves along a scan axis 628 in a direction parallel to the long axis of the first spindle 614. In another embodiment, the distance measurements could be made while printhead carriage 114 is stationary and the printhead cleaner 126 and the sled 124 are moving. In this last-described embodiment, the first window and the second window are aligned along an axis 634 at a right angle to the long axis of the first spindle 614, such that the first window 622 and the second window 632 are sequentially exposed to the sensor 120 as the sled 124 moves the printhead cleaner 126 beneath the printhead carriage 114 and sensor 120 (FIG. 1). In another embodiment, the distance measurements could be made while both the printhead carriage 114 and the printhead cleaner 126 are stationary.

Figure 9B:
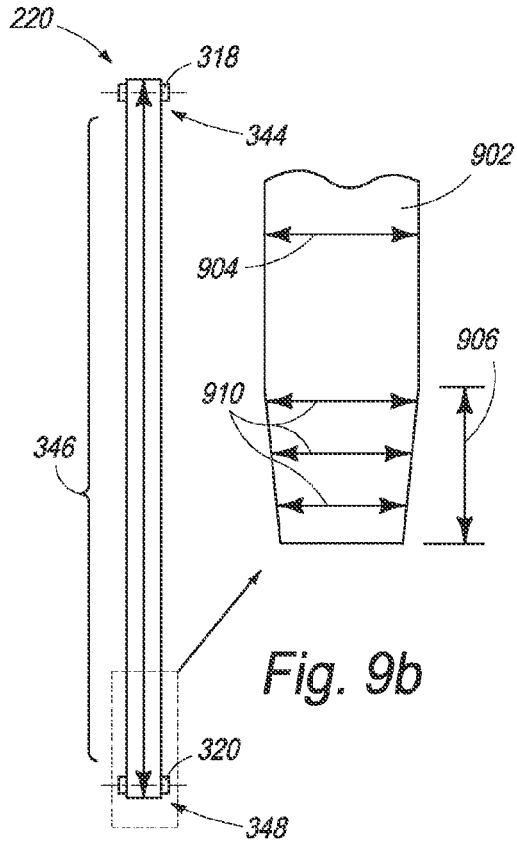

FIGS. 9*a* and 9*b* are top down views of lengths of wiping material 220 according to an embodiment of this disclosure. Beginning with FIG. 9*a*, the wiping material 220 comprises a first end portion 344 that is attached to the first spindle 318, and the second end portion 348 is attached to the second spindle 320. The middle portion 346 comprises all of the wiping material 220 other than the first and second end portions. In an embodiment, the wiping material 220 includes varying widths, the widths to correlate with the amount of unused wiping material 220 remaining on the first spindle 318. The middle portion 346 of the wiping material 318 comprises a first section 902 that adjoins the first end portion 344 and includes a first width 904. The middle portion 346 additionally includes a second section 906 that is connected to the first section 902 and to the second end portion 348, the second section including a second width 908 that is narrower than the first width 904. In an embodiment the second width 908 can be detected by a sensor 120 that is carried by the printhead carriage 114 (FIG. 1), such detection indicating the amount of unused wiping material remaining on the first spindle, and/or that the first spindle 318 is nearly empty of the wiping material 220.

Moving to FIG. 9*b*, in an embodiment the second section 906 is tapered to have a plurality of widths 910. The plurality of widths 910 progressively narrow in the direction of the second end portion 348 and the second spindle 320. When one of the plurality of widths 910 is measured by the sensor 120 (FIG. 1), the printer's controller can use the measured width and a lookup table to stored in memory to determine the amount of unused wiping material 220 remaining on the first spindle 318. The printer may be configured to send a message to a user via user interface (e.g. via a LED printer display device) or via an application running on a host computing device that is connected to the printer when a first predetermined minimum amount of wiping material 220 remains on the first spindle 318. The printer may be configured to inactivate printing operations when a second predetermined minimum amount of wiping material 220 remains on the first spindle 318.

Figure 9C:
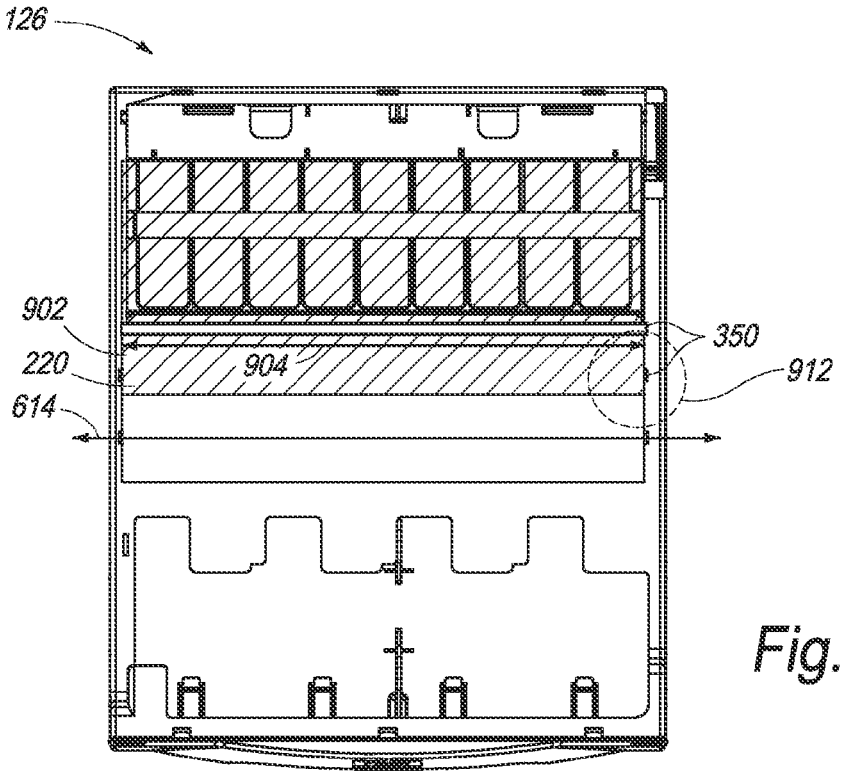
FIGS. 9*c* and 9*d* are top down views of an embodiment of the printhead cleaner of FIGS. 3*a* and 3*b*.
Figure 9D:
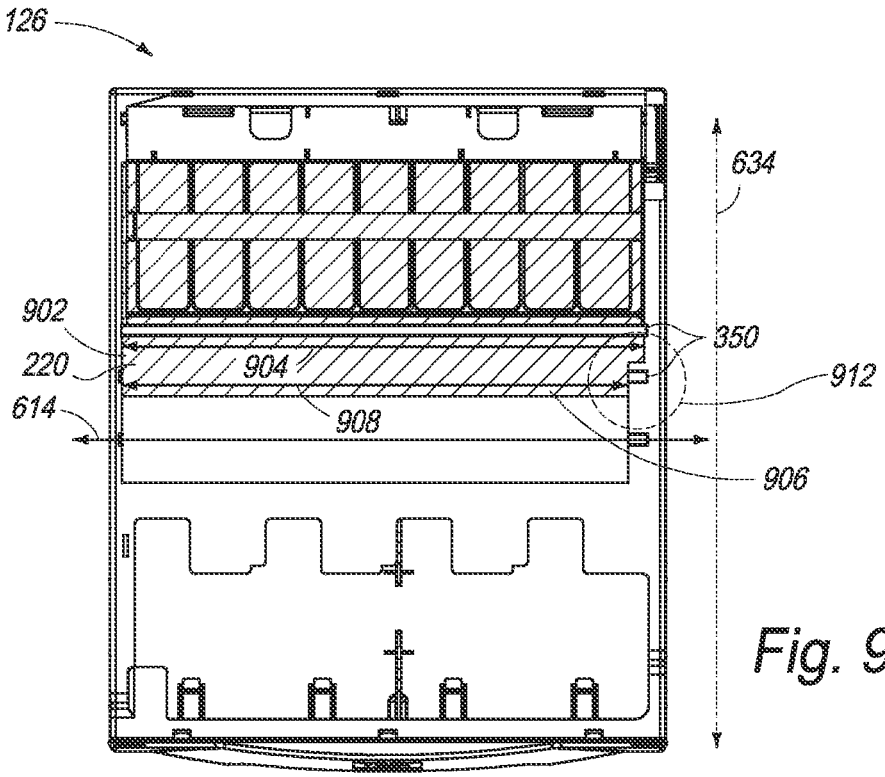

FIGS. 9*c* and 9*d* are top down views of an embodiment of the printhead cleaner of FIGS. 3*a* and 3*b*, including the wiping material of FIG. 9*a*. FIG. 9*c* illustrates a portion of the wiping material 220 with a first width 904 at a target 912 at which the sensor 120 (FIG. 1) measures the width of the wiping material, indicating the first spindle 318 (FIG. 4) has an adequate supply of unused wiping material. FIG. 9*d* illustrates a portion of the wiping material 220 with the narrowed second width 908 at the target 912, indicating the first spindle is nearly empty of unused wiping material. In an embodiment, the sensor 120 (FIG. 1) may be configured to detect the presence of the second width by measuring the light reflected at a target 912. In an example, the amount of light reflected to the sensor 120 is at a first level when the first width 904 is in view of the sensor 120 as the sensor detects light reflecting off of the wiping material surface. Continuing with this example, the amount of light reflected to the sensor is at a second increased level when the second width 908 is in view of the sensor 120. The increased level of detected light may be attributable to a metallic roller or other rotatable member 350 that is not visible to the sensor 120 when the wiping material at the target 912 has the first width 904, but which is visible to the sensor 120 when the wiping material has the second width 908.

In an embodiment a sensor reading to determine width of the wiping material 220 at the target 912 is made while the printhead carriage 114 and the sensor 120 (FIG. 1) are stationary and the printhead cleaner 126 is moved along a scan axis by the sled 124. In another embodiment, a distance measurement is made while printhead cleaner 126 is stationary and the printhead carriage 114 and the sensor 120 (FIG. 1) are moving. In this last-described embodiment, the scan axis is parallel to the long axis 614 of the first spindle. In another embodiment, a sensor reading is made while both the printhead carriage 114 and the printhead cleaner 126 are stationary.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printhead cleaner, comprising:

a container including a body, a cavity formed or partially formed by the body, and an aperture contiguous with the cavity;

a first rotatable spindle and a second rotatable spindle positioned within the cavity substantially parallel with each other, the first rotatable spindle to unwind unused wiping material, and the second rotatable spindle to wind used wiping material;

a plurality of suspension devices connected to the body, each suspension device including a supporting member operable to independently rotate around a common elongated member and a biasing device to bias the supporting member, the elongated member positioned within the cavity substantially parallel with the first rotatable spindle and the second rotatable spindle; and a plurality of wipers, each wiper including a wiping surface protruding through the aperture to engage and wipe a discrete printhead of a plurality of printheads during a wiping operation, and each wiper non-rotatable connected to a discrete suspension device of the plurality of suspension devices such that wiping force is independent for each discrete printhead during the wiping operation.

2. The printhead cleaner of claim 1, wherein each wiping surface comprises a plurality of wiping surfaces.

3. The printhead cleaner of claim 1, further comprising a transmission that is connected to the body and is operably connected to the second spindle to drive the second spindle.

4. The printhead cleaner of claim 1, further comprising a priming receptacle that is connected to the body and includes a plurality of printhead caps positioned adjacent to the aperture, the printhead caps to engage a plurality of printheads and the priming receptacle to receive liquid from the printheads during a priming operation.

5. The printhead cleaner of claim 1, wherein the elongated member is a first elongated member, and further comprising a second elongated member that is connected to the body and is positioned across the aperture, the second elongated member to support a length of the wiping material, the length to serve as a spittoon during a spitting operation.

6. The printhead cleaner of claim 1, further comprising:

a chamber that is connected to the body and that partially encloses the first spindle;

a path comprised within the chamber, the path perpendicular to and adjacent to the long axis of the first spindle;

a following member that is movable along the path, the following member including a contact portion to engage wiping material held by the first spindle, and a target portion to be detected by a sensor;

a window comprised within the chamber, the window adjacent to the path and to reveal the target portion to the sensor; and a biasing device connected to the chamber and to the following member, to bias the following member towards the first spindle.

7. An apparatus, comprising:

a housing including a body, a cavity defined or partially defined by the body, and an aperture contiguous with the cavity;

a first rotatable spindle and a second rotatable spindle movably attached to the body, the first rotatable spindle to distribute unused wiping material and the second rotatable spindle to collect used wiping material;

a plurality of suspension devices attached to the body, each suspension device comprising a biasing device and a supporting member biased by the biasing device;

an elongated member positioned within the cavity substantially parallel with the first rotatable spindle and the second rotatable spindle, the supporting member of each suspension device mounted on the elongated member such that the elongated member serves as an axis of rotation for each supporting member;

a plurality of wipers, each wiper including a wiping surface adjacent to the aperture to engage and wipe an individual printhead of a plurality of printheads during a wiping operation, and each wiper non-rotatably connected to an individual suspension device of the plurality of suspension devices such that wiping force is independent for each individual printhead during the wiping operation; and a wiping material that includes a first edge, a middle portion, and a second edge, the wiping material positioned such that the first edge is attached to the first spindle, the second edge is attached to the second spindle, and a part of the middle portion is movably connected to, and is suspended by, a plurality of rotatable members, the rotatable members movably attached to the body, such that the part of the middle portion is adjacent and exterior to the wiping surfaces.

8. The apparatus of claim 7, wherein each wiping surface comprises a plurality of wiping surfaces.

9. The apparatus of claim 7, wherein the wiping material comprises a liquid having a boiling point greater than about two hundred degrees C.

10. The apparatus of claim 7, wherein the middle portion comprises:

a first section that adjoins the first edge and includes a first width; and a second section that is connected to the first section and to the second edge and that includes a second width that is narrower than the first width, the second width to be detected by a sensor and to indicate that the first spindle is nearly empty of the wiping material.

11. The apparatus of claim 10, wherein the second section comprises a tapered portion.

12. The apparatus of claim 7, further comprising a transmission that is movably connected to the body and is operably connected to the second spindle, the transmission to rotate the second spindle.

13. The apparatus of claim 7, further comprising a priming receptacle that is connected to the body and includes a plurality of printhead caps positioned adjacent to the aperture, the printhead caps to engage a plurality of printheads and the priming receptacle to receive liquid from the printheads during a priming operation.

14. The apparatus of claim 7, wherein the elongated member is a first elongated member, and further comprising a second elongated member that is connected to the body and is positioned across the aperture, the second elongated member to support a length of the wiping material, the length to serve as a spittoon during a spitting operation.

15. A printhead cleaner, comprising:

a housing including a body, a cavity formed or partially formed by the body, and an aperture contiguous with the cavity;

a first and a second rotatable spindle positioned within the cavity such that their long axes are substantially parallel, the first spindle to unwind unused wiping material, and the second spindle to wind used wiping material;

a plurality of suspension devices that connect to the body, each suspension device comprising a biasing device that is connected to the body, and a supporting member that is connected to the biasing device and that is operable to rotate around an axis;

a first elongated member positioned within the cavity with a length parallel to the length of the first spindle, the first elongated member to serve an axis for each of the supporting members;

a plurality of wipers, each wiper including a plurality of wiping surfaces protruding through the aperture to engage and wipe a individual printhead during a wiping operation, and each wiper connected to a individual suspension device such that wiping force is independent for each individual printhead during the wiping operation;

a wiping material that includes a first end portion, a middle portion, and a second end portion, the wiping material positioned such that the first end portion is attached to the first spindle, the second end portion is attached to the second spindle, and a segment of the middle portion is movably connected to, and is suspended by, a plurality of rollers, the rollers movably connecting to the body, such that the segment is abutted with the wiping surfaces;

a transmission that is connected to the body and is operably connected to the second spindle to drive the second spindle;

a priming receptacle that is connected to the body and includes a plurality of printhead caps positioned adjacent to the aperture, the printhead caps to engage a plurality of printheads and the priming receptacle to receive liquid from the printheads during a priming operation; and a second elongated member that is connected to the body and is positioned across the aperture, the second elongated member to support a length of the wiping material, the length to serve as a spittoon during a spitting operation.

16. The printhead cleaner of claim 1, each wiper comprising a wiper blade.

17. The printhead cleaner of claim 1, further comprising a first rotatable member and a second rotatable member positioned within the cavity substantially parallel with the first rotatable spindle and the second rotatable spindle, the first rotatable member and the second rotatable member to support a length of the wiping material over the wipers.

18. The printhead cleaner of claim 17, wherein the first rotatable member is positioned along a path of the wiping material between the first rotatable spindle and the wipers, and the second rotatable member is positioned along a path of the wiping material between the wipers and the second rotatable spindle.

19. The printhead cleaner of claim 17, wherein the second rotatable member is positioned between the wipers and the elongated member.

* * * * *